US009103207B2

(12) United States Patent
Richards

(10) Patent No.: US 9,103,207 B2
(45) Date of Patent: Aug. 11, 2015

(54) MULTI-ZONE COMPLETION SYSTEMS AND METHODS

(71) Applicant: Halliburton Energy Services, Inc., Houston, TX (US)

(72) Inventor: William Mark Richards, Flower Mound, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/366,289

(22) PCT Filed: Aug. 12, 2013

(86) PCT No.: PCT/US2013/054474

§ 371 (c)(1),
(2) Date: Jun. 18, 2014

(87) PCT Pub. No.: WO2015/023249

PCT Pub. Date: Feb. 19, 2015

(65) Prior Publication Data

US 2015/0075780 A1 Mar. 19, 2015

(51) Int. Cl.

| | |
|---|---|
| ***E21B 34/10*** | (2006.01) |
| ***E21B 43/08*** | (2006.01) |
| ***E21B 43/26*** | (2006.01) |
| ***E21B 34/06*** | (2006.01) |
| ***E21B 17/04*** | (2006.01) |
| ***E21B 33/124*** | (2006.01) |
| ***E21B 43/04*** | (2006.01) |

(Continued)

(52) U.S. Cl.

CPC ..... *E21B 43/26* (2013.01); *E21B 17/04* (2013.01); *E21B 33/124* (2013.01); *E21B 34/06* (2013.01); *E21B 34/10* (2013.01); *E21B 43/04* (2013.01); *E21B 43/08* (2013.01); *E21B 43/082* (2013.01); *E21B 47/06* (2013.01); *E21B 47/065* (2013.01); *E21B 49/08* (2013.01)

(58) Field of Classification Search

CPC ..... E21B 43/08; E21B 43/14; E21B 34/06; E21B 34/10; E21B 34/14; E21B 43/26

See application file for complete search history.

(56) References Cited

U.S. PATENT DOCUMENTS 6,481,494 B1 11/2002 Dusterhoft et al.
6,601,646 B2 8/2003 Streich et al.

(Continued)

FOREIGN PATENT DOCUMENTS

WO 2015023249 A1 2/2015

OTHER PUBLICATIONS

International Search Report and Written Opinion for PCT/US2013/054474 dated May 13, 2014.

*Primary Examiner* — Catherine Loikith

(74) *Attorney, Agent, or Firm* — McDermott Will & Emery LLP; Scott Richardson

(57) ABSTRACT

A completion system includes an outer completion string having at least one sand screen arranged thereabout, one or more control lines extending externally along the outer completion string, a service tool arranged within the outer completion string and having an inner tubing that defines a valve conduit, and a valve arranged within the service tool. The control lines have one or more gauges operatively coupled thereto and arranged adjacent the at least one sand screen. The one or more gauges are configured for real-time monitoring and reporting of well environment parameters. The valve is movable between a first position and a second position. In the first position, fracturing fluid is allowed to circulate through the at least one sand screen and the valve and into the valve conduit. In the second position, the valve prevents the fracturing fluid from entering the valve conduit.

23 Claims, 5 Drawing Sheets

(51) Int. Cl.
*E21B 47/06* (2012.01)
*E21B 49/08* (2006.01)

(56) References Cited

U.S. PATENT DOCUMENTS 8,312,923 B2 11/2012 Patel et al.
2003/0111224 A1 6/2003 Hailey et al.
2007/0051507 A1 3/2007 Ross et al.
2009/0078427 A1 3/2009 Patel
2010/0139909 A1 6/2010 Tirado et al.
2011/0120726 A1 5/2011 Murray et al.
2012/0199346 A1* 8/2012 Patel et al. ..... 166/278
2013/0062066 A1 3/2013 Broussard et al.

* cited by examiner

MULTI-ZONE COMPLETION SYSTEMS AND METHODS

BACKGROUND

The present disclosure relates to the treatment of subterranean production intervals and, more particularly, to gravel packing and fracturing of multiple production intervals with a multi-zone completion system and monitoring downhole parameters in real-time during such operations.

In the production of oil and gas, drilled wells can reach depths of 31,000 feet or more below the ground or subsea surface. Offshore wells may be drilled in water exhibiting depths of 10,000 feet or more. The total depth from an offshore platform to the bottom of a drilled wellbore can be as much as eight miles. Such extraordinary distances in modern well construction can cause significant challenges in equipment, drilling, and servicing operations.

For example, tubular strings can be introduced into a well in a variety of different ways. It may take many days for a wellbore service string to make a "trip" into a wellbore, which may be due in part to the time-consuming practice of making and breaking pipe joints to reach the desired depth. Moreover, the time required to assemble and deploy any service tool assembly downhole for such a long distance is very time consuming and costly. Since the cost per hour to operate a drilling or production rig is very expensive, saving time and steps can be hugely beneficial in terms of cost-savings in well service operations. Each trip into the wellbore adds expense and increases the possibility that tools may become lost in the wellbore, thereby requiring still further operations for their retrieval. Moreover, each additional trip into the wellbore oftentimes has the effect of reducing the inner diameter of the wellbore, which restricts the size of tools that are able to be introduced into the wellbore past such points.

To enable the fracturing and/or gravel packing of multiple hydrocarbon-producing zones in reduced timelines, some oil service providers have developed multi-zone completion systems that enable operators to perforate a large wellbore interval at one time, then make a clean-out trip and run all of the screens and packers at one time. As will be appreciated, this minimizes the number of trips into the wellbore and rig days required to complete conventional fracture and gravel packing operations in multiple pay zones.

Achieving a full gravel pack is desirable for long-term reliability of sand control operation in such hydrocarbon-producing zones. Various techniques, such as shunt tubes or beta wave attenuators can be used for achieving a full gravel pack. During gravel packing and fracturing operations, it may prove advantageous to obtain real-time wellbore monitoring.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present disclosure relates to the treatment of subterranean production intervals and, more particularly, to gravel packing and fracturing of multiple production intervals with a multi-zone completion system and monitoring downhole parameters in real-time during such operations.

The use of directional terms herein, such as above, below, upper, lower, upward, downward, left, right, uphole, downhole and the like, are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Disclosed are embodiments for a service tool used in conjunction with a completion string in a wellbore penetrating one or more formation zones. The service tool may include a movable valve that is able to move between a first position, where fluids are able to be recirculated back uphole during gravel packing, and a second position, where recirculation is prevented and therefore allows the formation zones to be hydraulically fractured. The completion string may include various gauges and sensors that may be arranged at or adjacent the sand screens forming part of the completion string. The sensors may be configured to monitor wellbore parameters and conditions in real-time during the gravel packing and hydraulic fracturing operations. The real-time measurements may be transmitted to the surface where a well operator may decide to alter the gravel packing and hydraulic fracturing operations based on the measured data.

Figure 1:
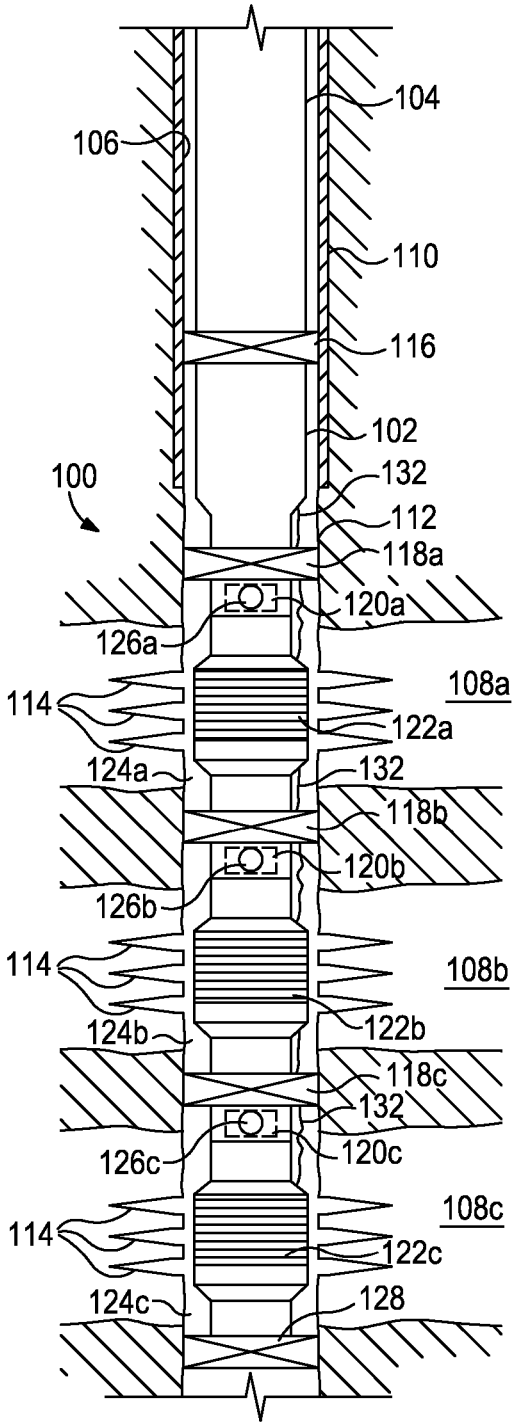
FIG. 1 illustrates an exemplary completion system that may employ one or more principles of the present disclosure, according to one or more embodiments.

Referring to FIG. 1, illustrated is an exemplary completion system 100 that may employ one or more principles of the present disclosure, according to one or more embodiments. As illustrated, the system 100 may include an outer completion string 102 that may be coupled to a work string 104 configured to extend longitudinally within a wellbore 106. The wellbore 106 may penetrate multiple subterranean formation zones 108*a*, 108*b*, and 108*c*, and the outer completion string 102 may be extended into the wellbore 106 until being arranged or otherwise disposed generally adjacent the formation zones 108*a-c*. The formation zones 108*a-c* may be portions of a common subterranean formation or hydrocarbon-bearing reservoir. Alternatively, one or more of the formation zones 108*a-c* may be portion(s) of separate subterranean formations or hydrocarbon-bearing reservoirs. The term "zone" as used herein, however, is not limited to one type of rock formation or type, but may include several types, without departing from the scope of the disclosure.

As will be discussed in greater detail below, the outer completion string 102 may be deployed within the wellbore 106 and used to hydraulically fracture ("frack") and gravel pack the various formation zones 108*a-c*, and subsequently intelligently regulate hydrocarbon production from each production interval or formation zone 108*a-c*. Although only three formation zones 108*a-c* are depicted in FIG. 1, it will be appreciated that any number of formation zones 108*a-c* (including one) may be treated or otherwise serviced using the completion system 100. Moreover, while the completion system 100 is depicted as being arranged within multiple zones 108*a-c*, it is also contemplated to position a variation of the completion system 100 within a single zone, without departing from the scope of the disclosure.

As depicted in FIG. 1, portions of the wellbore 106 may be lined with a string of casing 110 and properly cemented therein, as known in the art. The remaining portions of the wellbore 106, including the portions encompassing the formation zones 108*a-c*, may be an open hole section 112 of the wellbore 106 and the outer completion string 102 may be configured to be generally arranged therein during operation. In other embodiments, however, the casing string 110 may extend further into the wellbore 106 and otherwise encompass one or more of the formation zones 108*a-c*, without departing from the scope of the disclosure.

As will be discussed in more detail below, several fractures 114 may be initiated at or in each formation zone 108*a-c* and configured to provide fluid communication between each respective formation zone 108*a-c* and the annulus formed between the outer completion string 102 and walls of the open hole section 112. Particularly, a first annulus 124*a* may be generally defined between the first formation zone 108*a* and the outer completion string 102. Second and third annuli 124*b* and 124*c* may similarly be defined between the second and third formation zones 108*b* and 108*c*, respectively, and the outer completion string 102. In embodiments where the casing string 110 extends across the formation zones 108*a-c*, the casing string 110 may be perforated to allow fluid flow into each annulus 124*a-c*.

The outer completion string 102 may have a top packer 116 including slips (not shown) configured to support the outer completion string 102 within the casing 110 when properly deployed. In some embodiments, the top packer 116 may be a VERSA-TRIEVE® hangar packer commercially available from Halliburton Energy Services of Houston, Tex., USA. Disposed below the top packer 116 may be one or more isolation packers 118 (three shown as packers 118*a*, 118*b*, and 118*c*), one or more circulating sleeves 120 (three shown in phantom as sleeves 120*a*, 120*b*, and 120*c*), and one or more sand screens 122 (three shown as sand screens 122*a*, 122*b*, and 122*c*).

Each circulating sleeve 120*a-c* may be movably arranged within the outer completion string 102 and, as will be discussed below, may be configured to axially translate between open and closed positions. First, second, and third ports 126*a*, 126*b*, and 126*c* may be defined in the outer completion string 102 at the first, second, and third circulating sleeves 120*a-c*, respectively. When the circulating sleeves 120*a-c* are moved into their respective open positions, the ports 126*a-c* are exposed and may thereby provide fluid communication between the interior of the outer completion string 102 and the corresponding annuli 124*a-c*.

A service tool (not visible in FIG. 1), also known as a gravel pack service tool or a completion service tool, may be arranged concentrically within the outer completion string 102 and configured to regulate the gravel packing and hydraulic fracturing processes of each zone 108*a-c*. As will be discussed below, the service tool may include one or more shifting tools (not shown) used to open and/or close the circulating sleeves 120*a-c* and a valve that helps facilitate the introduction of a gravel pack within each annulus 124*a-c* and also facilitate the hydraulic fracturing process through the corresponding ports 126*a-c*.

The completion system 100 may further include one or more control lines 132 (one shown) extending externally along the outer completion string 102 and within each annulus 124*a-c*. The isolation packers 118*a-c* may include or otherwise be configured for control line bypass, which allows the control line 132 to pass therethrough external to the outer completion string 102. As will be described in greater detail below, the control line 132 may be representative of or otherwise include one or more electrical lines, one or more fiber optic lines, and/or one or more hydraulic lines communicably coupled to various sensors, gauges, and/or devices arranged within each annuli 124*a-c*. The hydraulic lines may be used to actuate various devices associated with the completion system 100 or the service tool, as will be described below. The electrical and fiber optic lines may include one or more accompanying electrical and/or fiber optic gauges or sensors configured for real-time monitoring and reporting of various fluid properties and well environment parameters within each annulus 124*a-c* during both the gravel packing and fracking operations.

The term "real-time monitoring" refers to the ability to observe downhole parameters (representing well characteristics) during some operation performed in the well, such as gravel packing and fracking operations. Example parameters that may be monitored in real-time include, but are not limited to, temperature, pressure, flow rate, water cut, fluid density, reservoir resistivity, oil/gas/water ratio, viscosity, carbon-oxygen ratio, acoustic parameters, chemical sensing (such as for scale, wax, asphaltenes, deposition, pH sensing, salinity sensing, etc.), combinations thereof, and the like.

In some embodiments, the fiber optic and electrical lines and associated gauges may be configured to measure temperature and pressure along the entire axial length of each sand screen 122*a-c*. This may be accomplished through the use of various fiber optic distributed temperature sensors, single point sensors, or electrical gauges (e.g., Halliburton's ROC™ permanent downhole gauges) arranged along the sand face. The fiber optic and electrical lines and associated gauges may further be configured to measure fluid pressure in discrete or predetermined locations within the annuli 124*a-c* and/or within the sand screens 122*a-c*. In some embodiments, the fiber optic and electrical lines and associated gauges may also be configured to measure acoustics along the sand face, such as through the use of distributed acoustic sensors (e.g., geophones). As will be appreciated, this may prove useful in determining where proppant is being distributed and provide an indication of potential erosion problems.

In some embodiments, the fiber optic and electrical lines of the control line 132 may provide an operator with two sets of monitoring data for the same or similar location within the annuli 124*a-c* or production intervals. In operation, the electric and fiber optical gauges may be redundant until one technology fails or otherwise malfunctions. As will be appreciated by those skilled in the art, using both types of instrumenting methods provides a more robust monitoring system against failures. Moreover, this redundancy may aid in accurately diagnosing problems with the wellbore equipment.

In order to deploy the completion system 100, it is first assembled at the surface and then lowered into the wellbore 106 on the work string 104. Upon properly aligning the sand screens 122*a-c* with the corresponding production zones 108*a-c*, the top packer 116 may be set within the casing 110, thereby anchoring or otherwise suspending the outer completion string 102 within the wellbore 106. The isolation packers 118*a-c* and a bottom packer 128 may also be set at this time using, for example, hydraulic fluid derived from the control line 132, and thereby defining individual production intervals corresponding to the various formation zones 108*a-c* between adjacent packers 118*a-c* and 128. The bottom packer 128 may be, for example, an open hole packer that acts as a sump packer, as generally known in the art.

Before producing hydrocarbons from the formation zones 108*a-c*, each formation zone 108*a-c* may be fracked in order to enhance hydrocarbon production, and each annulus 124*a-c* may be gravel packed to ensure limited sand production into the outer completion string 102 during production. The fracking and gravel packing processes for the outer completion string 102 may be accomplished sequentially or otherwise in step-wise fashion for each individual formation zone 108*a-c*, starting from the bottom of the outer completion string 102 and proceeding in an uphole direction (i.e., toward the surface of the well).

A fracturing fluid may be introduced into each annulus 124*a-c* via the respective ports 126*a-c*. The fracturing fluid may include a base fluid, a viscosifying agent, proppant particulates (including a gravel slurry), and one or more additives, as generally known in the art. The incoming gravel slurry builds in each annulus 124*a-c* and forms a gravel pack, which helps prevent the influx of sand or other particulates from the corresponding adjacent formation zone 108*a-c* into the outer completion string 102 during production. The fracturing fluid also serves to enhance the fractures 114 and extend a fracture network into each formation zone 108*a-c*.

Figure 2A:
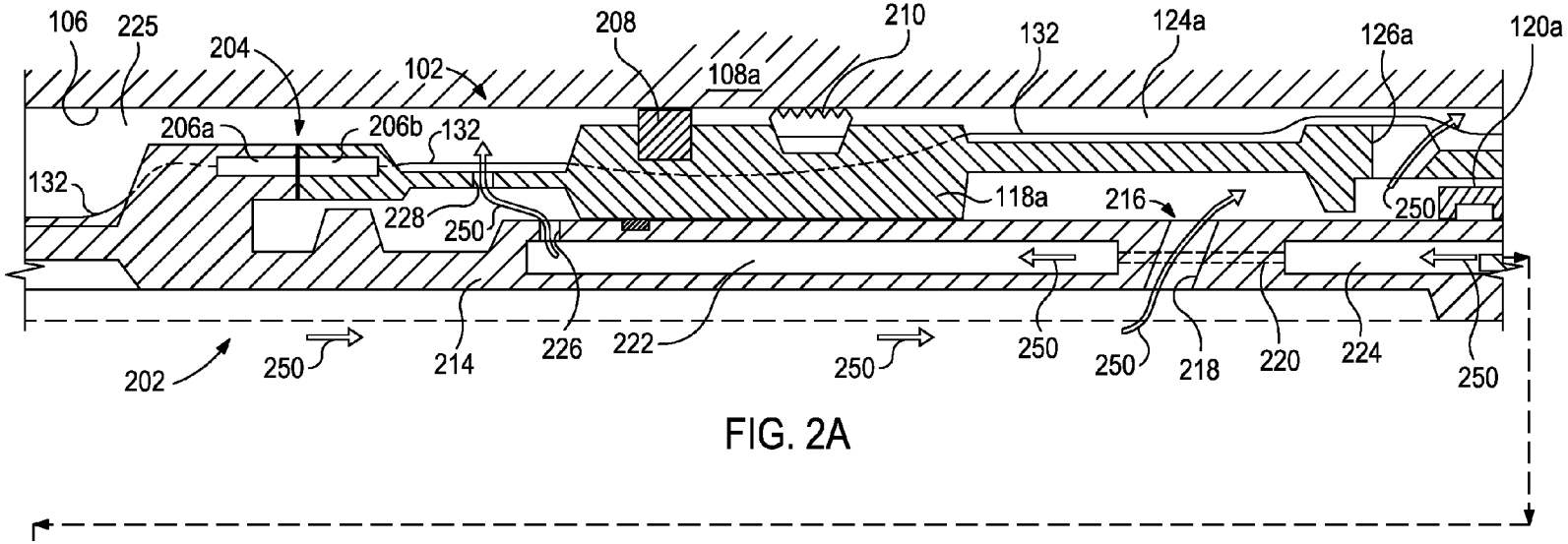
FIGS. 2A and 2B illustrate progressive cross-sectional views of an exemplary service tool arranged within the outer completion string of FIG. 1, according to one or more embodiments.
Figure 2B:
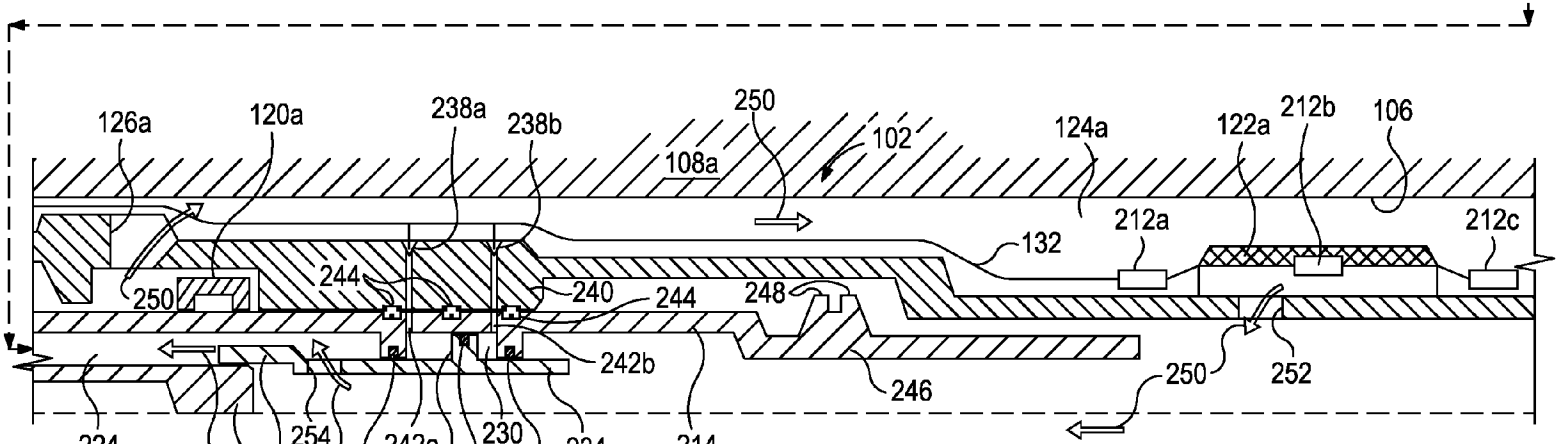

Referring now to FIGS. 2A and 2B, with continued reference to FIG. 1, illustrated are progressive cross-sectional views of an exemplary service tool 202 that may be arranged within a portion of the outer completion string 102 of FIG. 1, according to one or more embodiments. More particularly, FIG. 2A depicts an upper view of the service tool 202 and the outer completion string 102, and FIG. 2B depicts a continued view from the upper view of FIG. 2A. While FIGS. 2A and 2B indicate elements of the completion system 100 arranged adjacent the first formation zone 108*a* of FIG. 1, it will be appreciated that the following description may equally be representative of the outer completion string 102 and the service tool 202 as arranged adjacent any of the formation zones 108*a-c* described above.

As illustrated, the service tool 202 may be operatively coupled to the completion string 102 at a coupling interface 204 where the control line 132 that extends from the surface (not shown) is able to extend into and otherwise along the outer surface of the completion string 102. In some embodiments, the coupling interface 204 may include a wet mate connect (e.g., fiber optic, hydraulic, electric, or a hybrid hydraulic/electric) that provides an electrical and fiber optic wet mate connection between opposing male and female connectors 206*a* and 206*b*, respectively. In other embodiments, the coupling interface 204 may include a dry mate coupling and/or an inductive coupler providing an electromagnetic coupling or connection with no contact between the coupling interface 204 and the internal tubing. The dry mate coupling may be able to be disconnected by shearing the connection. In yet other embodiments, the fiber optic lines could be run across the coupling interface 204 without a connector. When the service tool 202 disconnects from the completion string 102, the control lines 132 may be sheared and unable to be reconnected. In any event, the coupling interface 204 may be configured to receive and extend one or more electrical, fiber optic, and/or hydraulic lines of the control line 132 further downhole to perform or otherwise facilitate various functions, including the real-time monitoring and reporting of fluid and/or well environment parameters, as generally discussed above.

While the coupling interface 204 depicts the male and female connectors 206*a* and 206*b* in an axially-aligned relationship, it is also contemplated herein to have a coupling interface 204 having male and female connectors coupling in the radial direction. Moreover, the coupling interface 204 may be housed in or otherwise include a floating bridge that allows for a small amount of axial movement. Such embodiments may prove useful in wet mate connections where a small amount of play is required to compensate for expansion and contraction of the completion string 102.

The completion string 102 includes the isolation packer 118*a* that, in at least one embodiment, may be actuated using hydraulic fluid derived from the control line 132. Upon actuation, the isolation packer 118*a* may expand or otherwise seal against the inner wall of the wellbore 106. In some embodiments, a sealing element 208, such as an elastomeric seal, may be included in the isolation packer 118*a* such that a more robust wall seal is achieved at that location. Moreover, the isolation packer 118*a* may also include an anchoring mechanism or packer slip 210. The packer slip 210 may be configured to grip the inner walls of the wellbore 106 and thereby help support the completion string 102 within the wellbore 106.

Referring to FIG. 2B, the control line 132 may extend axially past the port 126*a* and the circulating sleeve 120*a* and to the sand screen 122*a*. At or adjacent the sand screen 122*a*, one or more sensors or gauges 212 (shown as gauges 212*a*, 212*b*, and 212*c*) may be operatively coupled to the control line 132. As discussed above, the gauges 212*a-c* may be electrical and/or fiber optic gauges or sensors configured for real-time monitoring and reporting of various fluid properties and well environment parameters within the annulus 124*a* during both the fracking and gravel packing operations. Such parameters include, but are not limited to, pressure, temperature, and fluid flow rate. While only three gauges 212*a-c* are shown, those skilled in the art will readily appreciate that more or less than three gauges 212*a-c* may be employed. Moreover, while one gauge 212*b* is depicted as being arranged within the sand screen 122*a*, it will be appreciated that more than one gauge may be arranged within the sand screen 122*a* in order to facilitate real-time monitoring of wellbore parameters within the sand screen 122*a*. The second gauge 212*b* may be located in a groove exterior of the filter material or between two filter sections. The gauge 212*b* may be placed inside the filter material or in an axial flow path connected to the filter material, without departing from the scope of the disclosure.

The service tool 202 may include an inner tubing 214 that extends coaxially within the completion string 102. The inner tubing 214 may provide or otherwise include a crossover 216 that defines one or more radial ports 218 (one shown) and one or more axial ports 220 (one shown). When the port 126*a* defined adjacent the circulating sleeve 120*a* is exposed, the radial ports 218 may place the interior of the inner tubing 214 in fluid communication with the annulus 124*a*. The inner tubing 214 may further define a return conduit 222 and a valve conduit 224 that may be fluidly coupled via the axial ports 220 defined in the crossover 216. The return conduit 222 may be in fluid communication with an annulus 225 defined between the wellbore 106 and the completion string 102 above the isolation packer 118*a* via one or more ports 226 defined in the inner tubing 214 and one or more corresponding additional ports 228 defined in the completion string 102 above the isolation packer 118*a*.

The service tool 202 may further define a piston chamber 230 in the inner tubing 214 and a piston 232 may be movably arranged within the piston chamber 230. The piston 232 may be coupled to or otherwise form an integral part of a movable valve 234 used and included in the service tool 202. The valve 234 may include a stem 236 that extends axially from the piston 232 and into the valve conduit 224. In operation, as the piston 232 moves within the piston chamber 230, the stem 236 may be configured to correspondingly move axially within the valve conduit 224, as described in greater detail below.

Hydraulic fluid may be ported to the piston chamber 230 via a first hydraulic valve 238*a* and a second hydraulic valve 238*b* arranged in a seal bore 240 of the completion string 102. Each hydraulic valve 238*a,b* may be fluidly coupled to the control line 132 and configured to be actuated such that hydraulic fluid is selectively conveyed into the piston chamber 230 via either a first hydraulic port 242*a* or a second hydraulic port 242*b*, or both. Each hydraulic port 242*a,b* may be defined in the inner tubing 214 and otherwise place the piston chamber 230 in fluid communication with the first and second hydraulic valves 238*a,b*. More particularly, the first hydraulic port 242*a* may be fluidly coupled to the first hydraulic valve 238*a*, and the second hydraulic port 242*b* may be fluidly coupled to the second hydraulic valve 238*b*. In some embodiments, each hydraulic valve 238*a,b* may be fluidly coupled to its own independent hydraulic line included in the control line 132.

A plurality of sealing elements 244, such as o-rings, bonded seals, elastomeric member strips, or the like, may be arranged between the seal bore 240 and the inner tubing 214 at the piston chamber 230, and between the piston chamber 230 and the valve 234 such that sealed interfaces at each location are achieved. One or more additional sealing elements 244 may also be arranged between the piston 232 and the piston chamber 230 such that a sealed interface at that location is also achieved.

The service tool 202 may further include a shifting tool or shifter 246 arranged at or near the distal end of the inner tubing 214. Upon removal of the service tool 202 from the completion string 102, the shifter 246 may be configured to engage the circulating sleeve 120*a* and move it to a closed position where the port 126*a* is substantially occluded. In some embodiments, the shifter 246 may have one or more spring loaded keys 248 designed or otherwise configured to engage a corresponding profile defined in the inner surface of the circulating sleeve 120*a*. In other embodiments, the keys 248 may be omitted and otherwise replaced with a collet having a corresponding profile configured to match the profile defined in the inner surface of the circulating sleeve 120*a*.

In exemplary operation of the completion string 102 in conjunction with the service tool 202, a fracturing fluid 250 may be introduced downhole from the surface (not shown) and conveyed through the work string 104 (FIG. 1) to the completion string 102 and the service tool 202. As depicted in FIG. 2A, the fracturing fluid 250 may enter the interior of the service tool 202 and the inner tubing 214 and subsequently pass through and out of the inner tubing 214 via the radial ports 218 defined in the crossover 216. With the circulating sleeve 120*a* in its open position (as illustrated), the fracturing fluid 250 may be able to enter the annulus 124*a* via the port 126*a*.

Referring to FIG. 2B, the fracturing fluid 250 may deliver a gravel slurry (not shown) into the annulus 124*a* that builds within the annulus 124*a* and otherwise encompasses the sand screen 122*a*. The fracturing fluid 250, including amounts of proppant, may also extend into the surrounding formation zone 108*a* via the fractures 114 (FIG. 1). During this gravel packing process, the gauges 212*a-c* may be configured to continuously monitor various wellbore parameters, such as temperature and pressure. These measurements may be transmitted in real-time back to the surface via the control line 132. At the surface, a well operator may be able to consider these real-time measurements and intelligently regulate the gravel packing process as a result. For instance, in some embodiments, a well operator may decide to alter the pump rate of the fracturing fluid 250 or its proppant fluid density based on the real-time measurements. The well operator may also decide to adjust pumping pressures, fluid rheology, and frac fluid additives.

Some of the fracturing fluid 250 (less the gravel slurry and other particulate matter) may be recirculated back into the completion string 102 and the service tool 202 via the sand screen 122*a*. More particularly, some fracturing fluid 250 may return to the interior of the inner tubing 214 via one or more flow ports 252 (one shown) defined in the base pipe about which the sand screen 122*a* is arranged or disposed.

As described in greater detail below, the valve 234 may be movable between first and second positions depending on the input of hydraulic fluid via the first and second hydraulic valves 238*a,b*. As a result, depending on whether the valve 234 is in the first or second positions, the fracturing fluid 250 may either be allowed to enter the valve conduit 224 or may be prevented from entering the valve conduit 224. When the valve 234 is positioned to allow the fracturing fluid 250 to enter the valve conduit 224, the fracturing fluid 250 may do so via one or more valve ports 254 defined in the valve 234.

Referring again to FIG. 2A, the fracturing fluid 250 may flow from the valve conduit 224 into the return conduit 222 via the axial ports 220 defined in the crossover 216. From the return conduit 222, the fracturing fluid 250 may exit the completion string 102 via the ports 226 defined in the inner tubing 214 and the corresponding ports 228 defined in the completion string 102 above the isolation packer 118*a*. Once outside of the completion string 102 in the annulus 225 defined above the isolation packer 118, the fracturing fluid 250 may return to the surface and into return tanks where it may be stored. In some embodiments, the fluid return flow rate and pressure is measured, and the corresponding measurements, along with pump rate and pressure data, are analyzed in real-time to determine what is happening within the wellbore 106. For instance, well operators may monitor the difference in pressures looking for cues as to how much proppant each zone or interval can take. In response thereto, the well operator may slow the pumps to avoid bridging or an annular build up of proppant that stops the flow to the screens (e.g., sand screen 122*a*). The well operator may also speed up the pumps to cause the screens to intentionally plug to fill up the annular space (e.g., annulus 124*a*). The pressure and return data may prove advantageous in providing the well operator vital knowledge of what is happening in each zone (e.g., zones 108*a-c*).

Figure 3A:
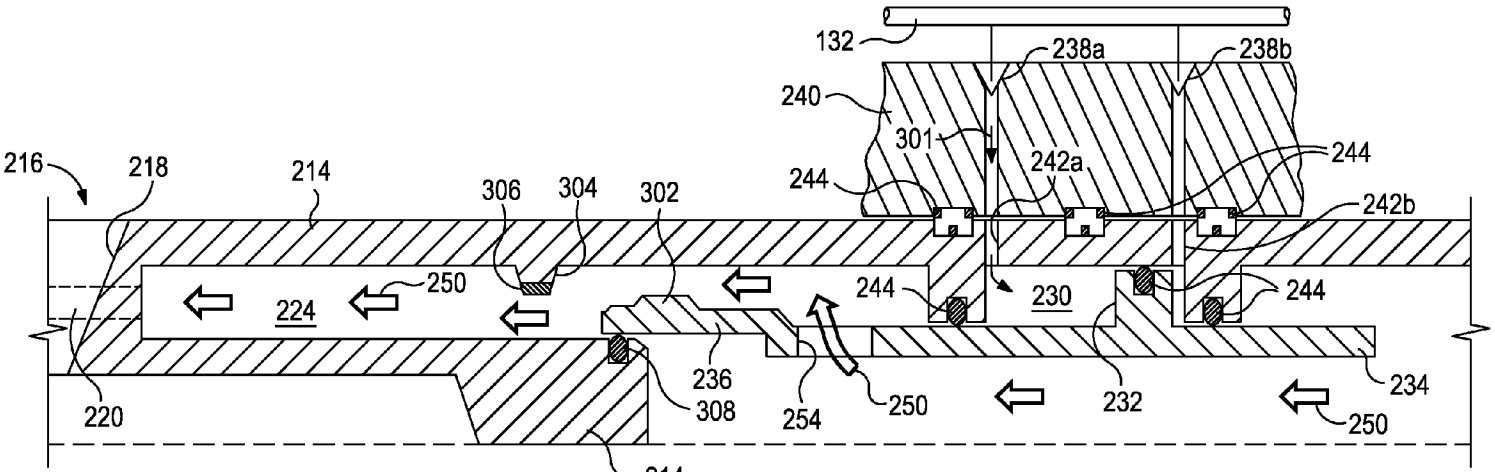
FIGS. 3A and 3B illustrate enlarged cross-sectional views of the valve of FIG. 2B and a portion of the service tool of FIGS. 2A-2B, according to one or more embodiments.
Figure 3B:
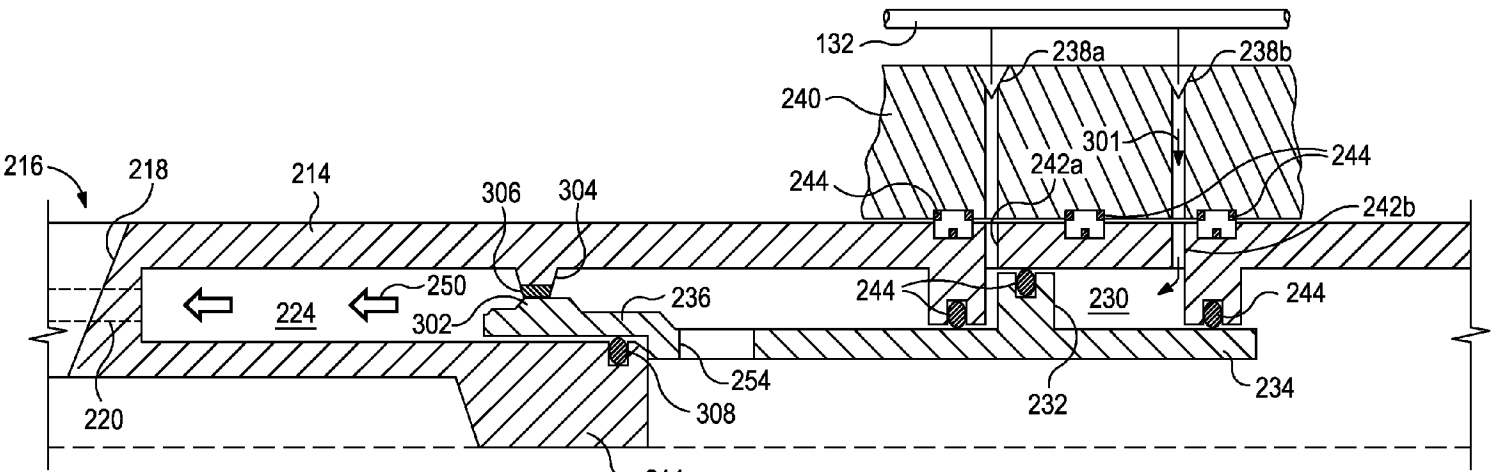

Referring now to FIGS. 3A and 3B, with continued reference to FIGS. 2A and 2B, illustrated are enlarged cross-sectional views of the valve 234 and a corresponding portion of the service tool 202, according to one or more embodiments. More particularly, FIG. 3A shows the valve 234 in a first position and FIG. 3B shows the valve 234 in a second position. The valve 234 is moved to the first position, or otherwise maintained in the first position, by pressurizing the piston chamber 230 via the first hydraulic valve 238*a* and the first hydraulic port 242*a*. The influx of hydraulic fluid 301 under pressure via the first hydraulic port 242*a* may serve to move the piston 232 to one end of the piston chamber 230 (e.g., the right end as seen in FIGS. 3A and 3B), and thereby to the first position.

When in the first position, the valve 234 may be arranged such that it allows the fracturing fluid 250 to enter the valve conduit 224 via the valve ports 254 (one shown). Once in the valve conduit 224, as discussed above, the fracturing fluid 250 may continue through the axial ports 220 defined in the crossover 216 and to the return conduit 222 (FIG. 2A). Continued application of hydraulic pressure via the first hydraulic port 242*a* will maintain the piston 232 and the valve 234 in the first position and therefore continue to allow flow of fracturing fluid 250 into the valve conduit 224. The various sealing elements 244 arranged between the seal bore 240 and the inner tubing 214, between the piston chamber 230 and the valve 234, and between the piston 232 and the piston chamber 230 ensure that a substantially sealed interface is maintained at those locations. The sealing elements 244 arranged between the piston chamber 230 and the valve 234 and between the piston 232 and the piston chamber 230 may also allow the valve 234 to slidingly move while maintaining a sealed interface.

Referring to FIG. 3B, the valve 234 may be moved to the second position, or otherwise maintained in the second position, by pressurizing the piston chamber 230 via the second hydraulic valve 238*b*. Similar to the first hydraulic valve 238*a*, the second hydraulic valve 238*b* may be actuated such that hydraulic fluid 301 may be derived from the control line 132 and conveyed into the piston chamber 230 via the second hydraulic port 242*b*. The influx of hydraulic fluid 301 under pressure via the second hydraulic port 242*b* may serve to move the piston 232 to the opposite end of the piston chamber 230 (e.g., the left end as seen in FIGS. 3A and 3B), and thereby to the second position.

As the piston 232 moves to the second position, the valve 234 correspondingly moves to the second position and effectively prevents fluid flow through the valve conduit 224. More particularly, the valve 234 may define or otherwise provide a radial protrusion 302 on the stem 236. As the valve 234 moves to the second position and the stem 236 is correspondingly extended axially into the valve conduit 224, the radial protrusion 302 may be configured to sealingly engage a molded seal 304 defined on the inner surface of the valve conduit 224. In some embodiments, the molded seal 304 can be an O-ring. In other embodiments, the molded seal 304 encompasses rubber that is bonded to a metal sleeve and seals like an O-ring. In yet other embodiments, the molded seal may be a plastic chevron seal stack, rubber with plastic seals, a spring energized plastic seal, combinations thereof, and the like.

As depicted, the molded seal 304 may extend radially from the inner surface of the valve conduit 224. In some embodiments, the molded seal 304 may include an elastomeric sealing element 306 disposed on its radial tip. The elastomeric sealing element 306 may be configured to substantially seal the interface between the radial protrusion 302 and the molded seal 304. As a result, fluid flow past that point in the valve conduit 224 may be substantially prevented. Another sealing element 308 may further be provided at the interface between the stem 236 and the inner tubing 214 such that a sealed interface is generated at that location, even while the valve 234 axially translates. Continued application of hydraulic pressure via the second hydraulic port 242*b* will maintain the piston 232 and the valve 234 in the second position and therefore continue to prevent flow of fracturing fluid 250 into the valve conduit 224.

Referring again to FIGS. 2A and 2B, when the valve 234 is in the second position the surrounding formation zone 108*a* may be hydraulically fractured or fracked. More particularly, the fracturing fluid 250 may continue to be pumped into the annulus 124*a* via the radial ports 218 of the crossover 216 and the port 126*a* when the circulating sleeve 120*a* is in its open position. With the valve 234 in the second position, the fracturing fluid 250 is unable to recirculate back into the completion string 102 and the service tool 202 via the sand screen 122*a*, but is instead forced under pressure deep into the formation zone 108*a*, thereby generating a fracture network therein.

During this fracking process, the gauges 212*a-c* may be configured to continuously monitor various wellbore parameters, such as temperature and pressure. These measurements may be transmitted in real-time back to the surface via the control line 132. At the surface, the well operator may be able to consider these real-time measurements and intelligently regulate the fracking operation. For instance, in some embodiments, a well operator may decide to alter the pump rate of the fracturing fluid 250 or its proppant fluid density based on the real-time measurements. The well operator may also decide to adjust pumping pressures and frac fluid additives.

Figure 4A:
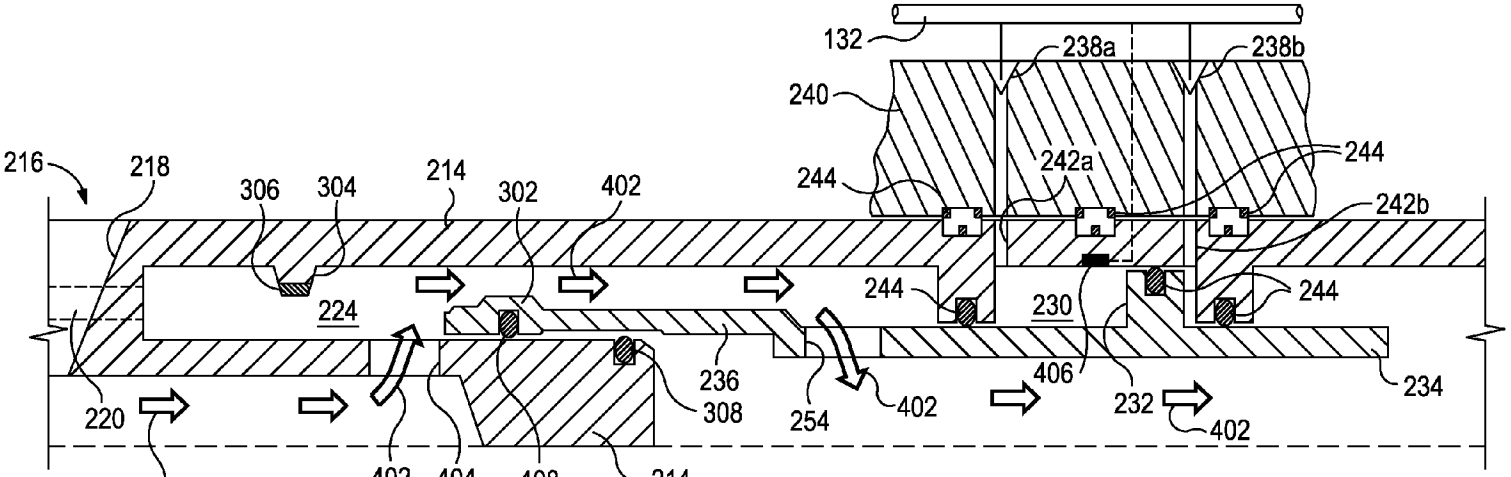
FIGS. 4A-4C illustrate enlarged cross-sectional views of the valve of FIG. 2B and a portion of the service tool of FIGS. 2A-2B, according to one or more embodiments.
Figure 4B:
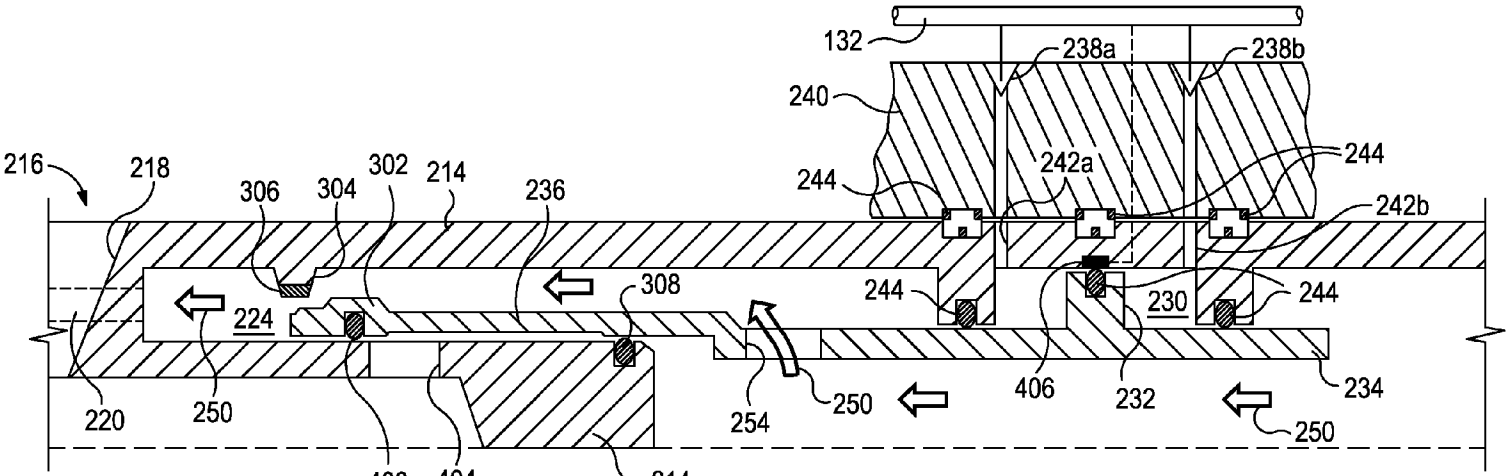
Figure 4C:
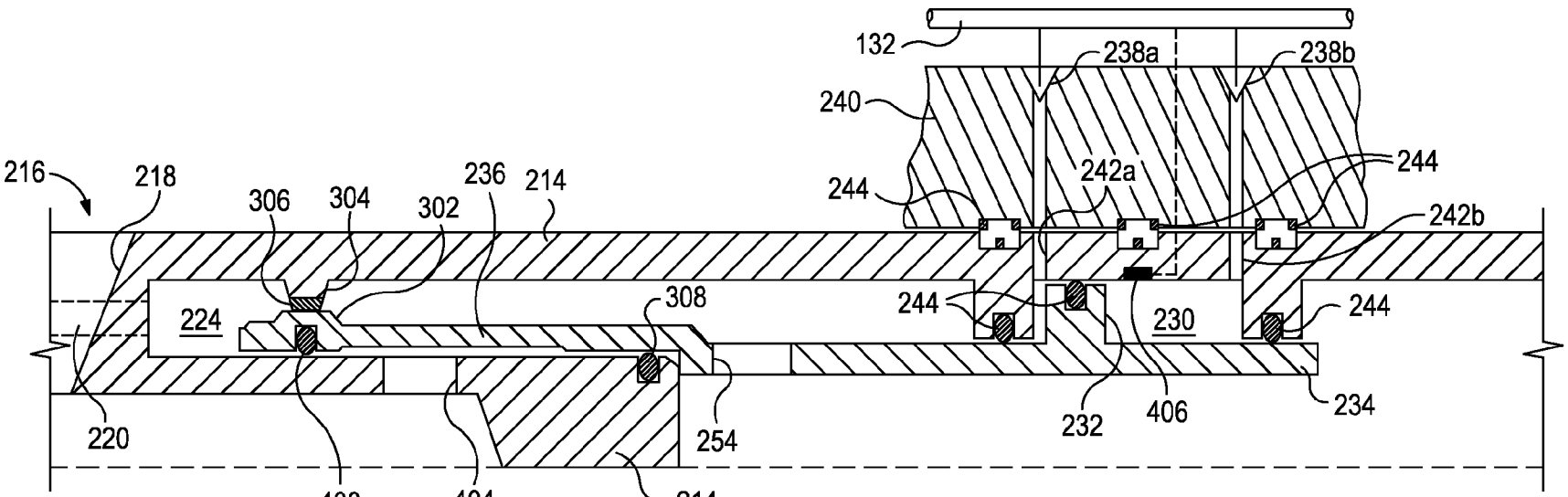

Referring now to FIGS. 4A-4C, with continued reference to FIGS. 2A-2B and 3A-3B, illustrated are enlarged cross-sectional views of another embodiment of the valve 234 and a corresponding portion of the service tool 202, according to one or more embodiments. Similar to FIGS. 3A and 3B, FIGS. 4A-4C depict the valve 234 in various possible positions during exemplary operation. More particularly, FIG. 4A shows the valve 234 in a first position, FIG. 4B shows the valve 234 in a second position, and FIG. 4C shows the valve 234 in a third position. The valve 234 is moved to or otherwise maintained in the first position by pressurizing the piston chamber 230 via the first hydraulic valve 238*a* and the first hydraulic port 242*a*.

When in the first position, the valve 234 may be arranged such that it allows a fluid 402 to be conveyed downhole through the interior of the inner tubing 214 and through the valve 234 such that the fluid 402 is able to be delivered further downhole. More particularly, the circulating sleeve 120*a* (FIGS. 2A-2B) may be in the closed position, thereby occluding the port 126*a*. As a result, the fluid 402 may be conveyed past the crossover 216 and able to exit the inner tubing 214 via one or more tubing ports 404 (one shown) defined in the inner tubing 214. The tubing ports 404 may provide fluid communication between the interior of the inner tubing 214 and the valve conduit 224. The fluid 402 may course into the valve conduit 224 and eventually exit therefrom via the valve ports 254 defined in the valve 234. The fluid 402 may then continue downhole within the completion string 102 and out a washpipe (not shown).

Continued application of hydraulic pressure via the first hydraulic port 242*a* will maintain the piston 232 and the valve 234 in the first position and therefore continue to allow flow of the fluid 402 downhole past the valve 234. Such an embodiment may prove useful in open hole applications, for example. In such applications, the fluid 402 may help wash out the open hole areas upon exiting the washpipe and thereby clear out any debris remaining from installing the completion string 102. Accordingly, the fluid 402 may be a salt water brine completion fluid with a gel mix to help pick up or move debris.

In other embodiments, the fluid 402 may continue downhole within the completion string 102 to a crossover port (not shown) located in another zone. As will be appreciated, this fluid 402 may enter one of the zones 108*b,c* (FIG. 1) located downhole, and a valve assembly similar to the valve 234 described herein may be included in each additional zone 108*b,c* and operate substantially similarly in order to treat each successive zone 108*b,c*

Referring to FIG. 4B, the valve 234 is depicted in a second position, where the fracturing fluid 250 is able to enter the valve conduit 224 via the valve ports 254. The second position may place the piston 232 in a generally centralized location within the piston chamber 230. In order to do this, the hydraulic input into the piston chamber 230 via the first and second hydraulic valves 238*a,b* and the first and second hydraulic ports 242*a,b* must be balanced. In some embodiments, one or more position sensors 406 (one shown) may be arranged at or adjacent the piston chamber 230 and configured to monitor the location of the piston 232 therein. The position sensor 406 may be communicably coupled to the control line 132 and otherwise configured to measure and report the position of the piston 232. Accordingly, the position of the valve 234 may be known and adjusted in real-time from the surface.

While the sensor 406 is shown in FIGS. 4A-4C as being arranged to monitor the position of the piston 230 within the piston chamber, those skilled in the art will readily recognize that the sensor 406 may be arranged at any location within the inner tubing 214 such that it is able to monitor and report the general location of the valve 234 as a whole. In some embodiments, for example, the sensor 406 may be arranged on the piston 232 itself or otherwise in the valve 234, without departing from the scope of the disclosure.

Once the fracturing fluid 250 is able to enter the valve conduit 224, as discussed above, the fracturing fluid 250 may continue through the axial ports 220 defined in the crossover 216 and to the return conduit 222 (FIG. 2A). Notably, in the second position, the valve 234 (e.g., a portion of the stem 236) may be configured to cover or otherwise occlude the tubing ports 404. Moreover, a sealing element 408 may be arranged between the proximal end of the valve 234 and the inner tubing 214 such that a sealed interface results at that location and, as a result, fluids are unable to pass into the valve conduit 224 via the tubing ports 404.

Referring to FIG. 4C, the valve 234 may be moved to the third position, or otherwise maintained in the second position, by pressurizing the piston chamber 230 via the second hydraulic valve 238*b* and the second hydraulic port 242*b*. As the piston 232 moves further to the third position, the valve 234 correspondingly moves and radial protrusion 302 defined on the stem 236 sealingly engages the molded seal 304, thereby preventing fluid flow past that point in the valve conduit 224. Continued application of hydraulic pressure via the second hydraulic port 242*b* will maintain the piston 232 and the valve 234 in the third position and therefore continue to prevent flow of the fracturing fluid 250 into the valve conduit 224.

In the third position, the surrounding formation zone 108*a* (FIGS. 2A and 2B) may be hydraulically fractured or fracked, as discussed above. Moreover, during this fracking process, the gauges 212*a-c* may be configured to continuously monitor various wellbore parameters, such as temperature and pressure. These measurements may be transmitted in real-time back to the surface via the control line 132 and the well operator may determine that changes should be made to the fracking process based on the real-time measurements, as discussed above.

Accordingly, the disclosed embodiments of the service tool 202 allow for the real-time monitoring of a frack job with various gauges 212*a-c* (FIGS. 2A-2B) arranged at or adjacent the sand screens 122*a*. Moreover, the service tool 202 may be characterized as a single position service tool that allows for the entire job to be pumped in a single position. This eliminates the need for an indicator coupling, and also reduces the amount of seals needed. Moreover, since the service tool 202 does not move during operation (apart from the valve 234), there is a reduced chance of sticking the service tool 202. Furthermore, the service tool 202 may be disconnected from the completion string 102 at the coupling interface 204 (FIGS. 2A-2B), and thereby disconnect the data monitoring capabilities via the control line 132 and the various gauges 212*a-c*. Data monitoring may then be reconnected later when tubing or the like is run into the wellbore 106 and coupled to the coupling interface 204 once again. In such embodiments, the coupling interface 204 may provide wet mate electric and fiber optic connections. In such embodiments, an anchor assembly is attached to the production tubing with wet mate connectors configured to locate, orient, align, and connect the wet mates to establish communication. The anchor also secures the tubing to the packer assembly to prevent movement. Such technology is generally disclosed in co-owned U.S. Pat. Nos. 8,082,998; 8,079,419; and 8,122,2967, and U.S. Patent Publication No. 2012/0181045.

Embodiments disclosed herein include:

A. A completion system that includes an outer completion string having at least one sand screen arranged thereabout, one or more control lines extending externally along the outer completion string and having one or more gauges operatively coupled thereto and arranged adjacent the at least one sand screen, the one or more gauges being configured for real-time monitoring and reporting of well environment parameters, a service tool arranged within the outer completion string and having an inner tubing that defines a valve conduit, and a valve arranged within the service tool and being movable between a first position, where fracturing fluid is allowed to circulate through the at least one sand screen and the valve and into the valve conduit, and a second position, where the valve prevents the fracturing fluid from entering the valve conduit.

B. A method that includes arranging an outer completion string within a wellbore adjacent one or more formation zones, the outer completion string having at least one sand screen arranged thereabout and one or more control lines extending externally along the outer completion string within an annulus defined within the wellbore and having one or more gauges operatively coupled thereto, the one or more gauges being arranged adjacent the at least one sand screen, receiving a fracturing fluid in a service tool arranged within the outer completion string, the service tool comprising an inner tubing that defines a valve conduit and a valve providing a stem that extends at least partially into the valve conduit, moving the valve to a first position, where the fracturing fluid is allowed to pass into the annulus and circulate through the at least one sand screen and the valve and into the valve conduit, and moving the valve to a second position, where the valve prevents the fracturing fluid from entering the valve conduit.

Each of embodiments A and B may have one or more of the following additional elements in any combination: Element 1: wherein the one or more control lines comprise at least one of hydraulic lines, electrical lines, and fiber optic lines. Element 2: wherein the service tool is operatively coupled to the outer completion string at a coupling interface. Element 3: wherein the coupling interface is at least one of a dry mate connector, a wet mate connector, and an inductive coupler. Element 4: wherein the wet mate connector is a connector selected from the group comprising a fiber optic connector, a hydraulic connector, an electric connector, and a hybrid hydraulic/electric connector. Element 5: wherein the well environment parameters comprise parameters selected from the group consisting of temperature, pressure, flow rate, water cut, fluid density, reservoir resistivity, oil/gas/water ratio, viscosity, carbon-oxygen ratio, combinations thereof, and the like. Element 6: wherein at least one of the one or more gauges is arranged within the at least one sand screen. Element 7: wherein the one or more gauges provide real-time monitoring during fracking and gravel packing operations. Element 8: further comprising a piston chamber defined in the inner tubing, a piston defined on the valve and movably arranged within the piston chamber, and first and second hydraulic valves configured to convey hydraulic fluid from the one or more control lines into the piston chamber via corresponding first and second hydraulic ports defined in the inner tubing, wherein, when the hydraulic fluid is introduced into the piston chamber via the first hydraulic valve and the first hydraulic port, the piston and the valve are moved to the first position, and wherein, when the hydraulic fluid is introduced into the piston chamber via the second hydraulic valve and the second hydraulic port, the piston and the valve are moved to the second position. Element 9: further comprising a stem that extends into the valve conduit, a radial protrusion defined on the stem, and a seal defined on an inner surface of the valve conduit, wherein, when the valve is moved to the second position, the radial protrusion sealingly engages the seal and thereby prevents the fracturing fluid from entering the valve conduit. Element 10: wherein the valve is movable to a third position between the first and second positions, wherein, when the valve is in the third position, a fluid is able to enter the valve conduit from the inner tubing and bypass the valve such that the fluid is conveyed downhole past the at least one sand screen within the outer completion string. Element 11: further comprising a piston chamber defined in the inner tubing, a piston defined on the valve and movably arranged within the piston chamber, and first and second hydraulic valves configured to convey hydraulic fluid from the one or more control lines into the piston chamber via corresponding first and second hydraulic ports defined in the inner tubing, wherein, when the hydraulic fluid is introduced into the piston chamber via the first hydraulic valve and the first hydraulic port, the piston and the valve are moved to the first position, wherein, when the hydraulic fluid is introduced into the piston chamber via the second hydraulic valve and the second hydraulic port, the piston and the valve are moved to the second position, and wherein, when the hydraulic fluid is introduced in balance into the piston chamber via the first and second hydraulic valves and the first and second hydraulic ports, respectively, the piston and the valve are moved to the third position. Element 12: further comprising one or more position sensors communicably coupled to the one or more control lines and configured to monitor the position of the valve.

Element 13: wherein arranging the outer completion string within the wellbore includes running the completion string into the wellbore with the service tool arranged therein and the one or more gauges arranged adjacent the at least one sand screen, locating the completion string at a sump packer arranged within the wellbore, and setting a top packer and one or more isolation packers using hydraulic pressure derived from the one or more control lines. Element 14: further comprising operatively coupling the service tool to the outer completion string at a coupling interface before running the outer completion string into the wellbore, wherein the coupling interface is at least one of a dry mate connector, a wet mate connector, and an inductive coupler. Element 15: further comprising disconnecting the service tool from the outer completion string at the coupling interface, and thereby disconnecting one or more control lines, and retrieving the service tool to a surface of the wellbore while the outer completion string remains within the wellbore. Element 16: further comprising introducing a production string into the wellbore from the surface, the production tubing including one or more connectors configured to mate with the coupling interface, and communicably coupling the production string to the outer completion string at the coupling interface via the one or more connectors. Element 17: further comprising monitoring and reporting well environment parameters in real-time during fracking and gravel packing operations using the one or more gauges, wherein the well environment parameters comprise parameters selected from the group consisting of temperature, pressure, flow rate, water cut, fluid density, reservoir resistivity, oil/gas/water ratio, viscosity, carbon-oxygen ratio, combinations thereof, and the like. Element 18: wherein the service tool further comprises a piston chamber defined in the inner tubing and a piston defined on the valve and movably arranged within the piston chamber, and wherein moving the valve to the first position comprises conveying hydraulic fluid to the piston chamber via a first hydraulic valve and a first hydraulic port defined in the piston chamber, and moving the piston to a first end in the piston chamber with the hydraulic fluid. Element 19: wherein moving the valve to the second position includes conveying the hydraulic fluid to the piston chamber via a second hydraulic valve and a second hydraulic port defined in the piston chamber, and moving the piston to a second end in the piston chamber with the hydraulic fluid. Element 20: further comprising advancing the stem into the valve conduit when the valve is moved to the second position, the stem defining a radial protrusion thereon, and sealingly engaging the radial protrusion on a seal defined on an inner surface of the valve conduit and thereby preventing the fracturing fluid from entering the valve conduit. Element 21: further comprising moving the valve to a third position between the first and second positions, circulating a fluid from the inner tubing into the valve conduit and past the valve such that the fluid is conveyed downhole past the at least one sand screen within the outer completion string. Element 22: further comprising monitoring the position of the valve with respect to the inner tubing using one or more position sensors communicably coupled to the one or more control lines.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The disclosure illustratively provided herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A completion system, comprising:

an outer completion string having at least one sand screen arranged thereabout;

one or more control lines extending externally along the outer completion string and having one or more gauges operatively coupled thereto and arranged adjacent the at least one sand screen, the one or more gauges being configured for real-time monitoring and reporting of well environment parameters;

a service tool arranged within the outer completion string and having an inner tubing that defines a valve conduit; and a valve arranged within the service tool and being movable between a first position, where fracturing fluid is allowed to circulate through the at least one sand screen and the valve and into the valve conduit, and a second position, where the valve prevents the fracturing fluid from entering the valve conduit.

2. The completion system of claim 1, wherein the one or more control lines comprise at least one of hydraulic lines, electrical lines, and fiber optic lines.

3. The completion system of claim 1, wherein the service tool is operatively coupled to the outer completion string at a coupling interface.

4. The completion system of claim 3, wherein the coupling interface is at least one of a dry mate connector, a wet mate connector, and an inductive coupler.

5. The completion system of claim 4, wherein the wet mate connector is a connector selected from the group comprising a fiber optic connector, a hydraulic connector, an electric connector, and a hybrid hydraulic/electric connector.

6. The completion system of claim 1, wherein the well environment parameters comprise parameters selected from the group consisting of temperature, pressure, flow rate, water cut, fluid density, reservoir resistivity, oil/gas/water ratio, viscosity, carbon-oxygen ratio, combinations thereof, and the like.

7. The completion system of claim 1, wherein at least one of the one or more gauges is arranged within the at least one sand screen.

8. The completion system of claim 1, wherein the one or more gauges provide real-time monitoring during fracking and gravel packing operations.

9. The completion system of claim 1, further comprising:

a piston chamber defined in the inner tubing;

a piston defined on the valve and movably arranged within the piston chamber; and first and second hydraulic valves configured to convey hydraulic fluid from the one or more control lines into the piston chamber via corresponding first and second hydraulic ports defined in the inner tubing, wherein, when the hydraulic fluid is introduced into the piston chamber via the first hydraulic valve and the first hydraulic port, the piston and the valve are moved to the first position, and wherein, when the hydraulic fluid is introduced into the piston chamber via the second hydraulic valve and the second hydraulic port, the piston and the valve are moved to the second position.

10. The completion system of claim 9, further comprising:

a stem that extends into the valve conduit;

a radial protrusion defined on the stem; and a seal defined on an inner surface of the valve conduit, wherein, when the valve is moved to the second position, the radial protrusion sealingly engages the seal and thereby prevents the fracturing fluid from entering the valve conduit.

11. The completion system of claim 1, wherein the valve is movable to a third position between the first and second positions, wherein, when the valve is in the third position, a fluid is able to enter the valve conduit from the inner tubing and bypass the valve such that the fluid is conveyed downhole past the at least one sand screen within the outer completion string.

12. The completion system of claim 11, further comprising:

a piston chamber defined in the inner tubing;

a piston defined on the valve and movably arranged within the piston chamber; and first and second hydraulic valves configured to convey hydraulic fluid from the one or more control lines into the piston chamber via corresponding first and second hydraulic ports defined in the inner tubing, wherein, when the hydraulic fluid is introduced into the piston chamber via the first hydraulic valve and the first hydraulic port, the piston and the valve are moved to the first position, wherein, when the hydraulic fluid is introduced into the piston chamber via the second hydraulic valve and the second hydraulic port, the piston and the valve are moved to the second position, and wherein, when the hydraulic fluid is introduced in balance into the piston chamber via the first and second hydraulic valves and the first and second hydraulic ports, respectively, the piston and the valve are moved to the third position.

13. The completion system of claim 12, further comprising one or more position sensors communicably coupled to the one or more control lines and configured to monitor the position of the valve.

14. A method, comprising:

arranging an outer completion string within a wellbore adjacent one or more formation zones, the outer completion string having at least one sand screen arranged thereabout and one or more control lines extending externally along the outer completion string within an annulus defined within the wellbore and having one or more gauges operatively coupled thereto, the one or more gauges being arranged adjacent the at least one sand screen;

receiving a fracturing fluid in a service tool arranged within the outer completion string, the service tool comprising an inner tubing that defines a valve conduit and a valve providing a stem that extends at least partially into the valve conduit;

moving the valve to a first position, where the fracturing fluid is allowed to pass into the annulus and circulate through the at least one sand screen and the valve and into the valve conduit; and moving the valve to a second position, where the valve prevents the fracturing fluid from entering the valve conduit.

15. The method of claim 14, wherein arranging the outer completion string within the wellbore comprises:

running the completion string into the wellbore with the service tool arranged therein and the one or more gauges arranged adjacent the at least one sand screen;

locating the completion string at a sump packer arranged within the wellbore; and setting a top packer and one or more isolation packers using hydraulic pressure derived from the one or more control lines.

16. The method of claim 15, further comprising operatively coupling the service tool to the outer completion string at a coupling interface before running the outer completion string into the wellbore, wherein the coupling interface is at least one of a dry mate connector, a wet mate connector, and an inductive coupler.

17. The method of claim 16, further comprising:

disconnecting the service tool from the outer completion string at the coupling interface, and thereby disconnecting one or more control lines; and retrieving the service tool to a surface of the wellbore while the outer completion string remains within the wellbore.

18. The method of claim 14, further comprising monitoring and reporting well environment parameters in real-time during fracking and gravel packing operations using the one or more gauges, wherein the well environment parameters comprise parameters selected from the group consisting of temperature, pressure, flow rate, water cut, fluid density, reservoir resistivity, oil/gas/water ratio, viscosity, carbon-oxygen ratio, combinations thereof, and the like.

19. The method of claim 14, wherein the service tool further comprises a piston chamber defined in the inner tubing and a piston defined on the valve and movably arranged within the piston chamber, and wherein moving the valve to the first position comprises:

conveying hydraulic fluid to the piston chamber via a first hydraulic valve and a first hydraulic port defined in the piston chamber; and moving the piston to a first end in the piston chamber with the hydraulic fluid.

20. The method of claim 19, wherein moving the valve to the second position comprises:

conveying the hydraulic fluid to the piston chamber via a second hydraulic valve and a second hydraulic port defined in the piston chamber; and moving the piston to a second end in the piston chamber with the hydraulic fluid.

21. The method of claim 20, further comprising:

advancing the stem into the valve conduit when the valve is moved to the second position, the stem defining a radial protrusion thereon; and sealingly engaging the radial protrusion on a seal defined on an inner surface of the valve conduit and thereby preventing the fracturing fluid from entering the valve conduit.

22. The method of claim 20, further comprising:

moving the valve to a third position between the first and second positions;

circulating a fluid from the inner tubing into the valve conduit and past the valve such that the fluid is conveyed downhole past the at least one sand screen within the outer completion string.

23. The method of claim 22, further comprising monitoring the position of the valve with respect to the inner tubing using one or more position sensors communicably coupled to the one or more control lines.

* * * * *